US011540616B2

(12) United States Patent
Hines

(10) Patent No.: US 11,540,616 B2
(45) Date of Patent: Jan. 3, 2023

(54) WEARABLE BABY CHANGING PLATFORM

(71) Applicant: Siska Hines, Goodyear, AZ (US)

(72) Inventor: Siska Hines, Goodyear, AZ (US)

( * ) Notice: Subject to any disclaimer, the term of this patent is extended or adjusted under 35 U.S.C. 154(b) by 0 days.

(21) Appl. No.: 17/541,341

(22) Filed: Dec. 3, 2021

(65) Prior Publication Data

US 2022/0240655 A1 Aug. 4, 2022

Related U.S. Application Data

(60) Provisional application No. 63/145,265, filed on Feb. 3, 2021.

(51) Int. Cl.
*A45F 4/02* (2006.01)
*A47D 5/00* (2006.01)

(52) U.S. Cl.
CPC ..... *A45F 4/02* (2013.01); *A47D 5/006* (2013.01)

(58) Field of Classification Search
CPC ..... A45F 4/02; A47D 5/006
See application file for complete search history.

(56) References Cited

U.S. PATENT DOCUMENTS

2005/0236450 A1* 10/2005 Iannini ..... A45F 3/15 224/577
2009/0158527 A1* 6/2009 Skophammer ..... A47D 5/006 5/655
2012/0311788 A1* 12/2012 Jackson, II ..... A47D 15/003 5/655
2014/0091007 A1* 4/2014 Garside ..... A45C 11/24 150/112
2015/0201761 A1* 7/2015 Wollenberg ..... A45F 4/02 224/160
2017/0303652 A1* 10/2017 Tate ..... A45C 3/00
2018/0078049 A1* 3/2018 Rhen ..... A45F 4/06
2018/0206650 A1* 7/2018 Kong ..... A45F 3/02
2021/0145188 A1* 5/2021 Thatcher ..... A45F 3/04
2022/0288440 A1* 9/2022 Bassoo ..... A63B 21/4037

* cited by examiner

*Primary Examiner* — Brian D Nash
(74) *Attorney, Agent, or Firm* — Bruce A. Lev

(57) ABSTRACT

A wearable baby diaper changing platform that is releasably attached to a user's body via a waist belt and padded neck strap. The platform includes a foldable pouch for holding a baby while changing diapers. A removable and foldable stiffener is incorporated within the foldable pouch. Additional panels having storage pockets are included to hold extra diapers, wipes, and supplies. Removable changing pads are also included along with safety straps to removably secure the baby onto the platform. The platform is adapted to be folded up and includes at least one shoulder strap for convenient over-the-shoulder carrying.

11 Claims, 8 Drawing Sheets

WEARABLE BABY CHANGING PLATFORM

CROSS-REFERENCE TO RELATED APPLICATION

There present application is related to and claims priority from prior provisional application Ser. No. 63/145,265, filed Feb. 3, 2021 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This present invention relates generally to the field of wearable baby changing platforms that are releasably attached to a user's body via a waist belt and neck strap.

2. Description of the Related Art

Previous baby changing platforms are bulky and are difficult to transport. Some have been designed to fold up for more convenient transport but are still bulky and heavy. In most situations transporting and/or carrying a changing platform is extremely difficult and not an option. Furthermore, parents or caregivers to babies have a difficult time finding baby changing stations in public places. There are many instances when there are no baby changing stations or a clean surface to change a baby on and parents/caregivers have to change their babies on a dirty restroom floor or on top of a wet sink or on their lap while uncomfortably squatting down. Further, there are never any changing stations in men's public restrooms. In some instances, when there's no changing station in any of the restrooms, parents resort to changing their babies in a hot sweltering car or when it's very cold outside.

Various attempts have been made to solve some of these problems. One in particular is U.S. Pat. No. 10,334,962 to Hornor, which includes a baby diaper changing platform that is releasably attached to a user's body via a waist belt and padded neck strap. However, Hornor's platform incorporates rigid frame members that can harm a baby's body when contacted, and includes a fabric pouch that is not rigid and does not offer enough support to the baby's body. Furthermore, Hornor's platform does not provide a means for storing extra diapers, wipes, and supplies. Therefore, a need exists for a baby diaper changing platform that overcomes the above-mentioned problems.

BRIEF SUMMARY OF THE INVENTION

In view of the foregoing disadvantages inherent in the known baby diaper changing platforms and information readily available art, the present invention provides a novel wearable baby diaper changing platform. The general purpose of the present invention, which will be described subsequently in greater detail, is to provide a wearable baby diaper changing platform that is releasably attached to a user's body via a waist belt and padded neck strap. The wearable platform includes a foldable pouch for holding a baby while changing diapers. A removable and foldable stiffener is incorporated within the foldable pouch. Additional panels having storage pockets are included to hold extra diapers, wipes, and supplies. Removable changing pads are also included along with safety straps to removably secure the baby onto the platform. The wearable platform is adapted to be folded up and includes at least one shoulder strap for convenient over-the-shoulder carrying.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments and method(s) of use for the present invention, A Wearable Baby Changing Platform, constructed and operative according to the teachings of the present invention.

Figure 1:
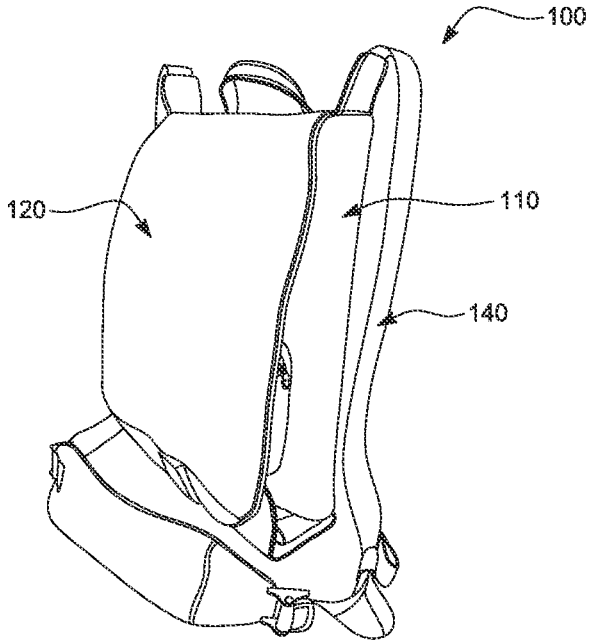
FIG. 1 shows a perspective view illustrating the Wearable Baby Changing Platform in a folded/closed configuration according to an embodiment of the present invention.
Figure 2:
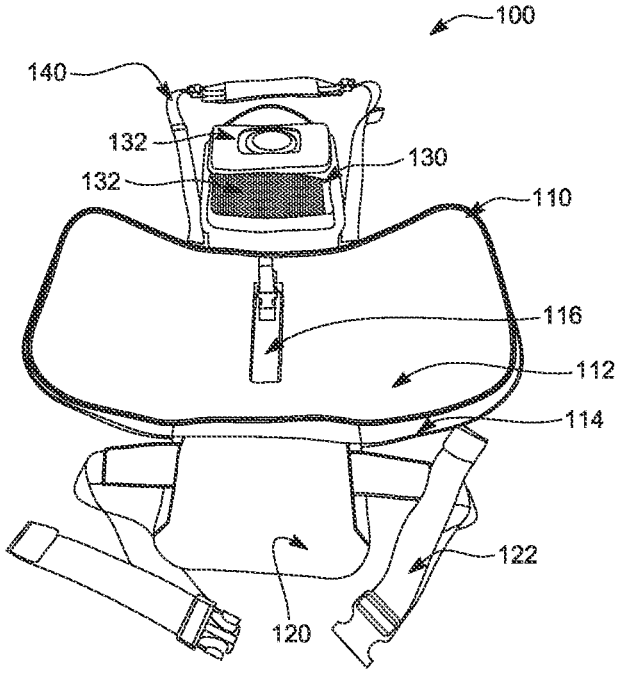
FIG. 2 shows a perspective view illustrating the Wearable Baby Changing Platform in an opened configuration according to the embodiment of the present invention of FIG. 1.
Figure 3:
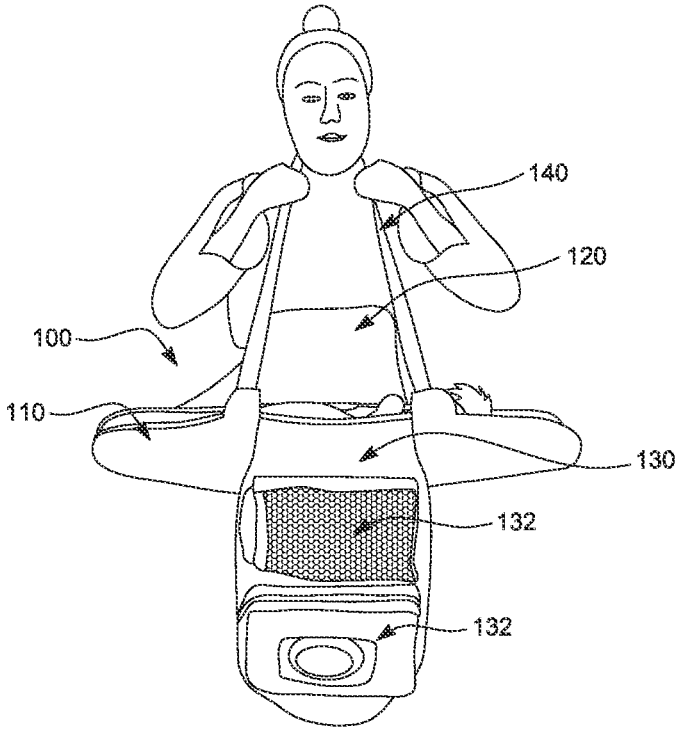
FIG. 3 shows a front view illustrating the Wearable Baby Changing Platform being worn by a user according to the embodiment of the present invention of FIG. 1.

The various embodiments of the present invention will hereinafter be described in conjunction with the appended drawings.

DETAILED DESCRIPTION

As discussed above, embodiments of the present invention relate to a wearable baby diaper changing platform that is releasably attached to a user's body via a waist belt and padded neck strap. The wearable platform includes a foldable pouch for holding a baby while changing diapers. A removable and foldable stiffener is incorporated within the foldable pouch. Additional panels having storage pockets are included to hold extra diapers, wipes, and supplies. Removable changing pads are also included along with safety straps to removably secure the baby onto the platform. The wearable platform is adapted to be folded up and includes at least one shoulder strap for convenient over-the-shoulder carrying.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Referring now to the drawings FIGS. 1-5, the wearable baby diaper changing platform 100 comprises a foldable pouch 110 that includes a top layer of material 112 and a bottom layer of material 114 that are connected to one another and form an interior volume adapted to allow a stiffening member 200 to be removably inserted therein. Foldable pouch 110 is designed to form a curved shape adapted to hold a baby's body therein in a secure and comfortable position. An adjustable pouch strap member 116 attached to a center section thereof and extends above the top layer of material 112 and includes two strap members releasably connected together at respective ends thereof and is adapted to releasably hold the baby within the foldable pouch 110. The top layer of material 112 of the foldable pouch 110 is formed from a waterproof material that is adapted to be wiped clean easily.

A body panel 120 is attached to the foldable pouch 110 at one edge thereof and is adapted to be placed against a user's body. The body panel 120 includes an adjustable waist strap 122 attached thereto and includes two strap members releasably connected together at respective ends thereof and is adapted to releasably hold the wearable baby diaper changing platform 100 against the body of the user adjacent their waist area.

A storage panel 130 is attached to the foldable pouch 110 at one edge thereof, opposite from the edge the body panel 120 is attached to, and is adapted to hang down from the foldable pouch 110 a distance from the user's body. Storage panel 130 includes a plurality of storage pockets 132 that are adapted to hold extra diapers, wipes, and supplies therein for easy access.

An adjustable padded neck strap 140 is attached to the foldable pouch 110 at the same edge as storage panel 130 and is adapted to be placed around the neck of the user and releasably hold the wearable baby diaper changing platform 100 in its proper orientation adjacent to the user's body.

Figure 4:
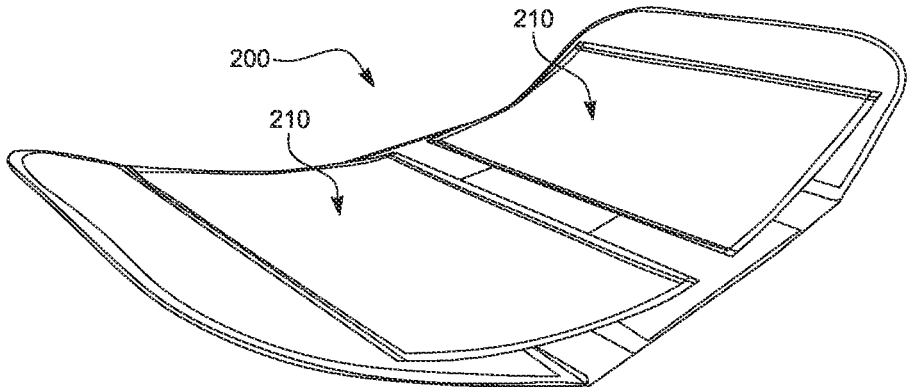
FIG. 4 shows a perspective view of the pouch stiffening panel incorporating retainer panels and in an unfolded configuration according to the embodiment of the present invention of FIG. 1.
Figure 5:
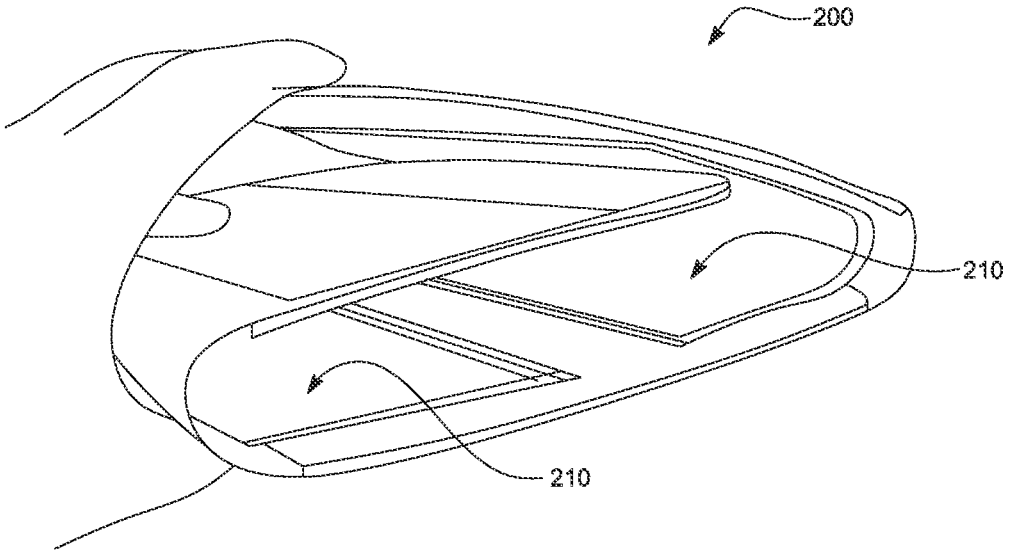
FIG. 5 shows a perspective view of the pouch stiffening panel in a folded configuration according to the embodiment of the present invention of FIG. 1.
Figure 6:
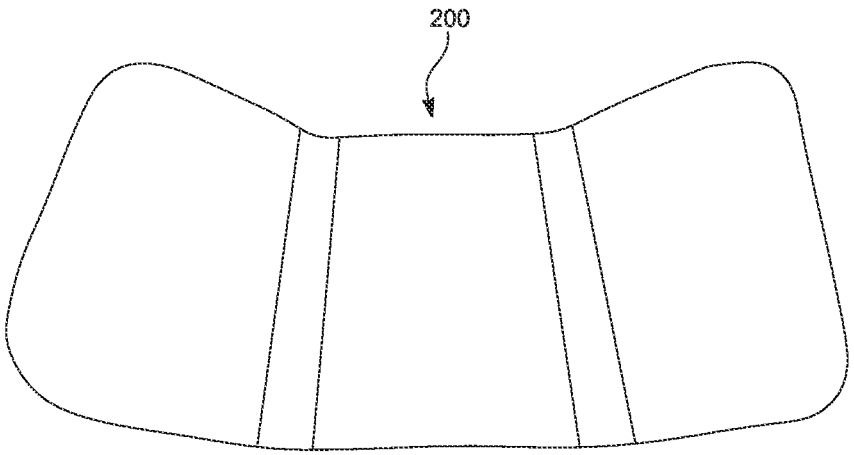
FIG. 6 shows a perspective view of the pouch stiffening panel according to the embodiment of the present invention of FIG. 1.

As shown in FIGS. 4-6, the removable and foldable stiffener 200 is removably placed within the interior volume of the foldable pouch 110. A foldable stiffener 200 is incorporated and formed from a rigid material that may have shape memory, ie. plastic, fiberglass, or leather, and is formed having a U-shaped cross section adapted to more safely and comfortable hold a baby's body therein. Retainer panels 210 may be attached thereto and in such a way as to hold the foldable stiffener 200 in the desired shape having the U-shaped cross section. The retainer panels 210 may be formed from a flexible material, ie. nylon or a woven material. FIG. 4 shows foldable stiffener 200 in an unfolded orientation before being placed within the interior volume of the foldable pouch 110. FIG. 5 shows foldable stiffener 200 in a folded orientation to which the stiffener will be in when inside the interior volume of the foldable pouch 110 and when the wearable baby diaper changing platform 100 is folded and in the storage/carrying orientation. FIG. 6 shows another embodiment having the foldable stiffener 200 being formed as one panel formed in the desired U-shape and formed from a material adapted to retain its shape after folding and unfolding.

When in the closed configuration, a strap may be incorporated releasably connected between exterior surfaces of the body panel 120 and the storage panel 130 to thereby releasably hold the wearable baby diaper changing platform 100 in the closed configuration. The releasable connection can be of many embodiments, including magnetic members.

The adjustable waist strap 122 may be formed as a high-waisted, buckled belt which acts as the main support and stabilizer for the foldable pouch 110. The adjustable padded neck strap 140 has dual uses as a neck strap and as an over-the-shoulder carrying strap. The foldable stiffener 200 may also be permanently inserted and enclosed within the foldable pouch 110. Fabrics used to form the outer layers of material of the foldable pouch 110, the body panel 120, and the storage panel 130 may all also be formed from waterproof material adapted to be wiped clean easily.

Figure 7:
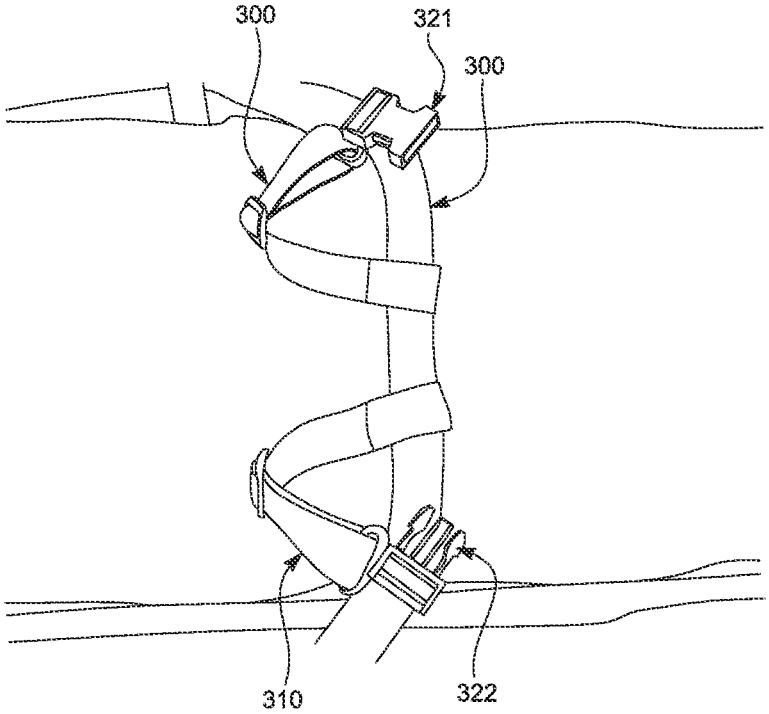
FIG. 7 shows a perspective view of a baby securement assembly according to an embodiment of the present invention of FIG. 1.
Figure 8:
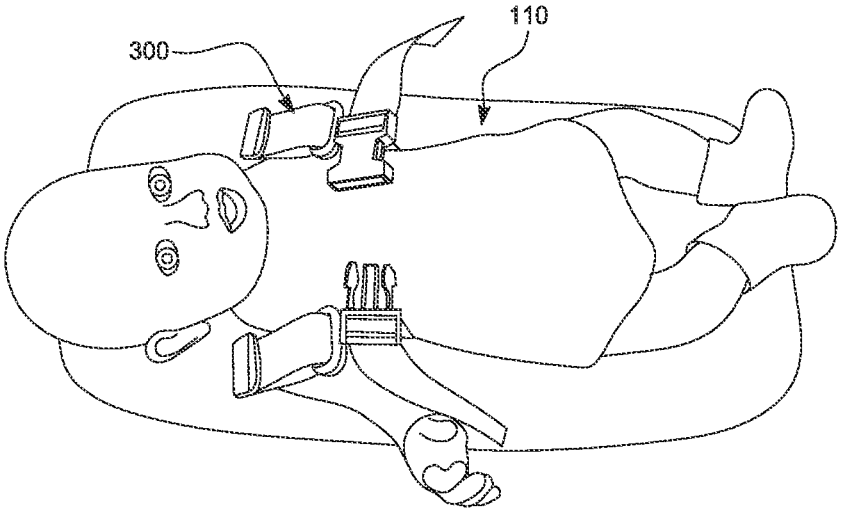
FIG. 8 shows a perspective view of a baby being secured to the Wearable Baby Changing Platform via the baby securement assembly according to an embodiment of the present invention of FIG. 7.

As shown in FIGS. 7 and 8, a baby securement assembly 300 can be incorporated to securely and releasably hold a baby within foldable pouch 110. The baby securement assembly 300 includes shoulder straps 310 and releasable fasteners 321 and 322 adapted to allow a baby to be securely and releasably hold a baby within the foldable pouch 110.

It should be noted that the position of the storage pockets 132 can vary upon the wearable baby diaper changing platform 100 depending on the needs and requirements of the user.

In an alternate embodiment, the foldable stiffener 200 can be sewn directly to the bottom layer of material 114 of the foldable pouch forming a "truss tension".

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A wearable baby diaper changing platform comprising:

a foldable pouch comprising:

a top layer of material;

bottom layer of material wherein said top layer of material and said bottom layer of material are connected to one another and form an interior volume;

a stiffening member;

wherein said stiffening member is sized, shaped, and adapted to be removably inserted within said interior volume of said foldable pouch;

wherein when said stiffening member is inserted into said interior volume said foldable pouch forms a curved shape adapted to hold a baby therein in a secure and comfortable position;

an adjustable pouch strap member;

wherein said adjustable pouch strap member is attached to a center section of said top layer of said foldable pouch and is adapted to releasably hold said baby within said foldable pouch;

a body panel including:

wherein said body panel is attached to said foldable pouch at one edge thereof and is adapted to be placed against a user's body;

an adjustable waist strap;

wherein said adjustable waist strap is attached to said body panel and is adapted to releasably hold said wearable baby diaper changing platform against the body of said user adjacent their waist area;

a storage panel including:

a plurality of storage pockets;

wherein said plurality of storage pockets are adapted to hold diapers, wipes, and supplies therein for easy access;

wherein said storage panel is attached to said foldable pouch at one edge thereof, opposite from said edge said body panel is attached to; and an adjustable neck strap;

wherein said adjustable neck strap is attached to said foldable pouch at the same edge as said storage panel and is adapted to be placed around the neck of said user and releasably hold said wearable baby diaper changing platform adjacent to said user's body.

2. The wearable baby diaper changing platform of claim 1, wherein said stiffening member is formed as a flat panel.

3. The wearable baby diaper changing platform of claim 1, wherein said adjustable pouch strap member includes two strap members releasably connected together at respective ends thereof and that are adapted to releasably hold said baby within said foldable pouch.

4. The wearable baby diaper changing platform of claim 1, wherein said top layer of material is formed from a waterproof material.

5. The wearable baby diaper changing platform of claim 1, wherein said adjustable waist strap includes two strap members releasably connected together at respective ends thereof.

6. The wearable baby diaper changing platform of claim 1, wherein said adjustable neck strap includes padding thereon.

7. The wearable baby diaper changing platform of claim 1, wherein said stiffening member is formed having a U-shaped cross section.

8. The wearable baby diaper changing platform of claim 1, wherein said stiffening member includes at least one retainer panel attached thereto adapted to bend and hold said stiffening member in a shape having a U-shaped cross section.

9. The wearable baby diaper changing platform of claim 7, wherein said stiffening member is formed from memory foam.

10. The wearable baby diaper changing platform of claim 1, further comprising a strap member attached to and between an exterior surfaces of said body panel and said storage panel and is adapted to releasably hold said wearable baby diaper changing platform in a closed configuration.

11. The wearable baby diaper changing platform of claim 1, further comprising a baby securement assembly including shoulder straps and releasable fasteners adapted to securely and releasably hold said baby within said foldable pouch.

* * * * *